US005105869A

United States Patent [19]

Rozon

[11] Patent Number: 5,105,869

[45] Date of Patent: Apr. 21, 1992

[54] VERTICAL BLIND CLIP

[75] Inventor: David P. Rozon, Russell, Canada

[73] Assignee: 139088 Canada Ltee, Jean-Proulx, Canada

[21] Appl. No.: 714,600

[22] Filed: Jun. 13, 1991

[30] Foreign Application Priority Data

Jun. 14, 1990 [CA] Canada ..... 2019024

[51] Int. Cl.[5] ..... E06B 9/36

[52] U.S. Cl. ..... 160/178.1; 160/900

[58] Field of Search ..... 160/178.1, 900; 403/61

[56] References Cited

U.S. PATENT DOCUMENTS

| | | | |
|---|---|---|---|
| 1,858,801 | 5/1932 | Bolard | 160/900 X |
| 2,768,679 | 10/1956 | Kiefer | 160/900 X |
| 2,768,680 | 10/1956 | Seymour | 160/900 X |
| 3,106,240 | 10/1963 | Weber | 160/900 X |
| 3,709,585 | 1/1973 | Tsai | 403/61 X |
| 4,922,986 | 5/1990 | Leibowitz | 160/178.1 |

FOREIGN PATENT DOCUMENTS

| | | | |
|---|---|---|---|
| 7609987 | 3/1978 | Netherlands | 160/178.1 |

*Primary Examiner*—Carl D. Friedman
*Assistant Examiner*—Derek J. Berger
*Attorney, Agent, or Firm*—John A. Baker

[57] ABSTRACT

The present invention is a link adapted to connect facing vanes of a vertical blind. Each of the links is comprised of an articulated arm engaged to said vanes by a cleat pivotally engaged to each end thereof. The articulated arm is comprised of first and second limbs, the first limb having a channel therein and the second limb having means to pivotally and slideably engage the channel. In a preferred embodiment, the channel is formed by an elongate loop extending from an end of the first limb, and the engagement means comprises a pin extending from the free end of the second limb, adapted to slideably engage the loop. The articulated arm is somewhat longer than the width of a single vane, in order to minimize the possibility of the edge of the vane becoming entangled in the joint between the arms.

4 Claims, 3 Drawing Sheets

VERTICAL BLIND CLIP

The present invention is related to our earlier Canadian application 593,957, and relates to a link for use in vertical window blinds, to connect the free lower end portions of the vanes of such blinds. Such a link is used to prevent the free ends of the vanes from tangling and flapping, for example where the blind hangs in front of an open window. A link for this application must be capable of allowing the blind to open and close freely, and thus must allow both horizontal displacement and rotational movement of the vanes. At the same time, the link must be sufficiently rigid to limit unwanted movement of the vanes.

A variety of means are known to connect the free ends of the vanes of a vertical window blind to each other. U.S. Pat. No. 4,696,336 discloses an arrangement of chains that links the lower end portions of a set of vanes, and U.S. Pat. No. 2,717,035 discloses an articulated strip that runs the length of a set of vanes, each segment of which is rotatably attached to the lower end of a vane. Other similar examples are known to the art. Such devices suffer several disadvantages. They are in general complex both to manufacture and to install into an already assembled blind, the latter being a frequent requirement in "custom" applications. Rigid links known to the art tend to be heavy, highly visible and unsightly, while chain link devices fail to provide a secure link, become entangled, and are difficult to assemble so as to maintain proper spacing between the vanes.

It is also desirable to provide a link whereby the connecting means readily disengage from the vane in the event, for example, of a young child running into the blind. Further, it is desirable to provide a link whereby small discrepancies in the manufacture or assembly of the link or the window blind may be tolerated without causing the link to jam or otherwise malfunction.

The present invention is a link adapted to connect facing vanes of a vertical blind. Each of the links is comprised of an articulated arm engaged to said vanes by a cleat pivotally engaged to each end thereof. The articulated arm is comprised of first and second limbs, the first limb having a channel therein and the second limb having means to pivotally and slideably engage the channel. In a preferred embodiment, the channel is formed by an elongate loop extending from an end of the first limb, and the engagement means comprises a pin extending from the free end of the second limb, adapted to slideably engage the loop. The articulated arm is somewhat longer than the width of a single vane, in order to minimize the possibility of the edge of the vane becoming entangled in the joint between the arms.

The invention will now be described by way of a preferred embodiment wherein.

Figure 1:
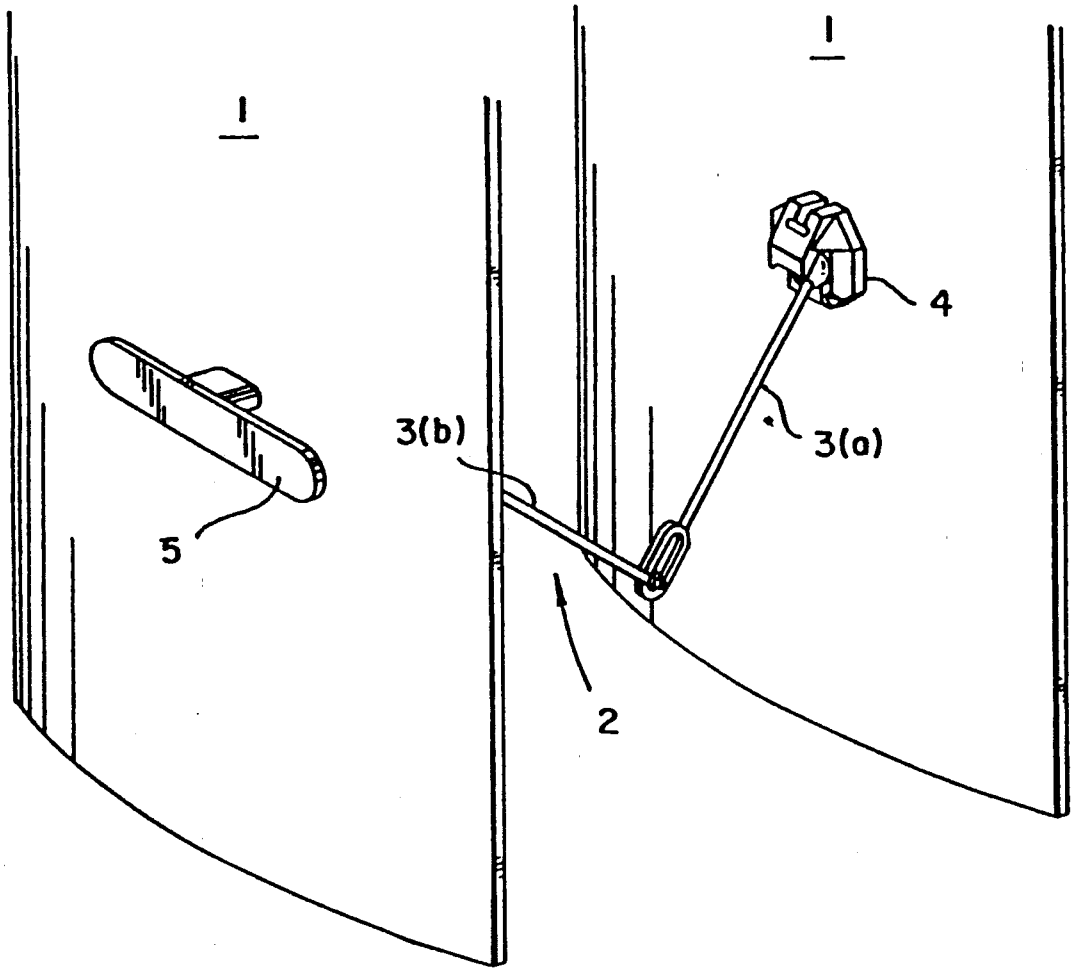
FIG. 1 is a perspective view of a portion of a set of vertical blinds, illustrating the free ends of two vertical blind vanes, connected by a set of links according to the present invention.

Referring to FIG. 1, the lower free ends of vanes 1 of a vertical blind are illustrated, connected by an arrangement of links 2. Vanes 1 are flat or nearly flat and are made of stiffened fabric, plastic or other reasonably rigid material. The arrangement of links consists of a series of interlocking elements, comprised of articulated arms having first and second limbs 3(*a*) and 3(*b*), cleats 4 connecting the arms to the vanes and a decorative end cap 5 at each end of the arrangement. Each limb 3 is engaged at a first end to a cleat 4 and at a second end to a second limb 3. At both such engagement points, the limb 3 is capable of vertical pivotal movement relative to its engaged member.

Figure 2:
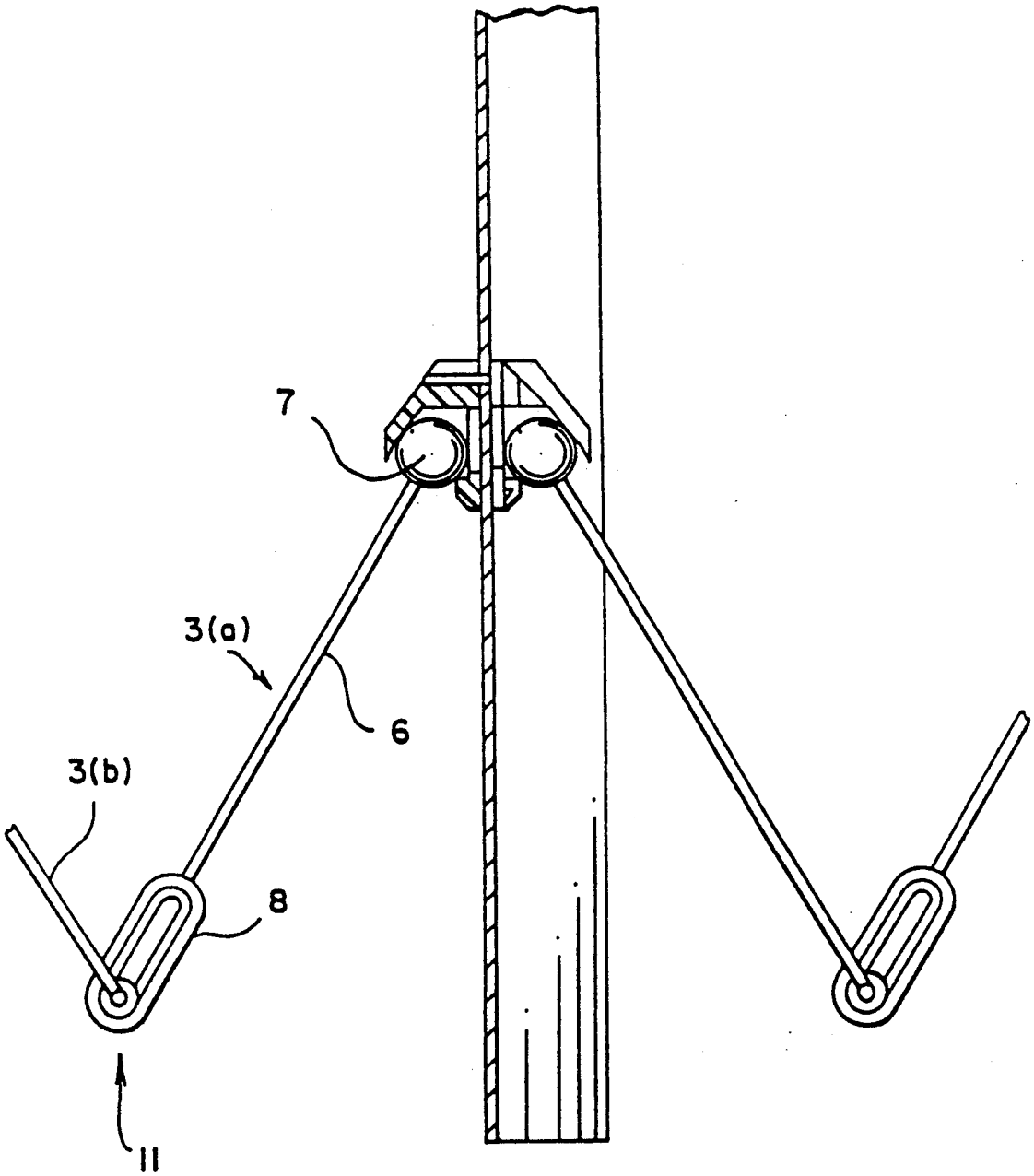
FIG. 2 is a side elevational view, partly in crosssection, illustrating portions of two links positioned on a vane.
Figure 3:
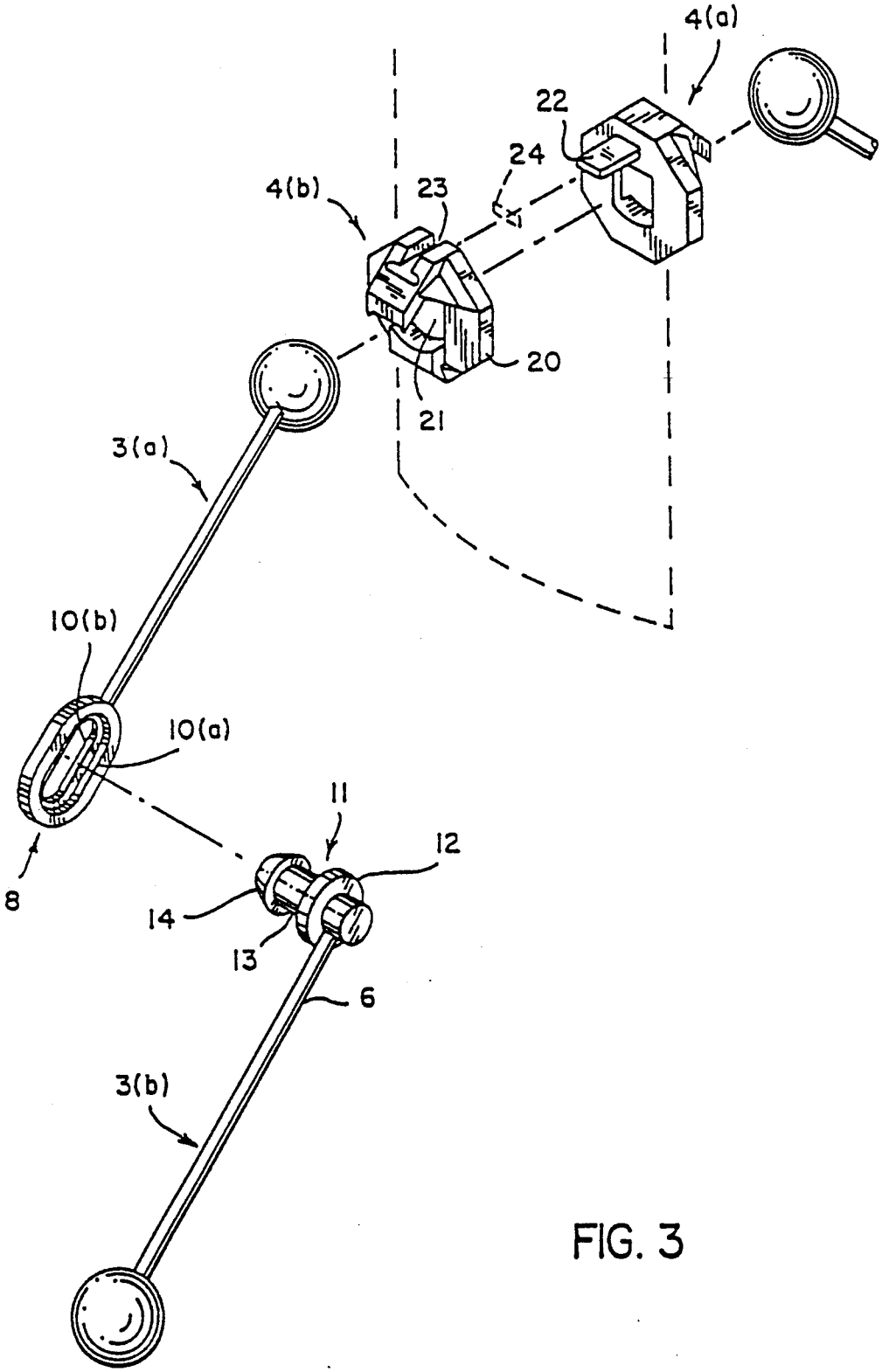
FIG. 3 is a perspective view of an arm portion of a link connecting to a second arm portion.

Referring to FIG. 2 and 3, the limbs 3(*a*) and 3(*b*) are illustrated in greater detail. Both limbs 3 have a straight elongate shaft 6, terminating at a first end with a ball 7. The second end of the first limb 3(*a*) terminates in an elongate loop 8, illustrated in cross-section in FIG. 3(*a*). The loop 8 is provided with internal shoulders 10(*a*) and 10(*b*) on either side thereof. The second limb 3(*b*) terminates in a pin 11 extending outwardly at right angles to the shaft 6. The pin 11 is comprised of a collar 12, a neck 13, and a head 14. The head 14 has a rounded free end to facilitate insertion of the pin 11 into the loop 8. In use, the pin 11 is snap fitted into the loop 8, the collar 12 and head 14 resting against opposing shoulders 10(*a*) and 10(*b*). The collar 12 is of sufficient thickness to extend slightly beyond the outer edge of the loop 8, and thus to provide a baffle to prevent a free edge of the vane 1 from becoming lodged between the two limbs. Opposing male and female cleats 4(*a*) and 4(*b*) attach to each other, on opposing faces of the vane 1. Each cleat 4(*a*) and 4(*b*) is provided with a plate 20, with a socket 21 extending outwardly therefrom. The male cleat 4(*a*) has a generally rectangular spike 22 extending outwardly from the inside face of the plate 20. The female spike 4(*b*) has a receiving channel 23 adapted to grip the spike 23. The spike 22 passes through an aperture 24 within the vane 1.

In use, a series of links may be assembled to link any number of vanes. The end cap 5 and cleats 4 are engaged to the vanes 1, and links 2 are snap fitted into the sockets thereof. It is desirable to mount the cleats 4 as close as possible to an imaginary horizontal line connecting each vane. Small deviations from this line however are compensated for by the ability of the pin to slide within the channel 23, thus allowing the limbs to dangle freely without being forced to one side or the other as a result of misalignment of the cleats.

The elements making up the arrangement of links are made of a resilient material such as polycarbonate, that provides sufficient flexibility to allow the limbs to snap out of their respective fittings when subjected to a sudden force, for example that created by a small child falling into the blinds, but to retain sufficient resiliency to hold the elements together when subjected to the forces associated with normal everyday use of the blinds.

The limbs are each of a length sufficient to extend beyond the edge of the associated vane, in order to further discourage the edge of the vane from becoming lodged between the limbs.

It will be seen that various alterations may be made to the described embodiment without departing from the spirit and scope of the invention, as claimed in the appended claims.

The embodiments of the invention in which an exclusive property or privilege is claimed are defined as follows:

1. In combination with a plurality of vertical blind vanes, a link adapted to connect facing vanes comprising an articulated arm engaged to each of said vanes by a cleat, wherein said arm is pivotally and releasably retained by said cleat, by means of a releasable ball and socket joint therebetween, said arm comprising first and second limbs, said first limb having a channel therein and said second limb having means to slidably and pivotally engage said channel.

2. An arrangement as claimed in claim 1, wherein said second limb is provided with a pin extending at right angles thereto, having means to slideably and pivotally engage said channel.

3. An arrangement as claimed in claim 2, wherein said channel is provided with a recessed shoulder therein, and said pin is provided with a collar adapted to engage said shoulder and cooperate therewith to discourage the edges of the vane from becoming lodged between the first and second limbs.

4. An arrangement as claimed in claim 1, wherein said first and second limbs are of a length sufficient to extend beyond the side edges of the vanes.

* * * * *